US009336766B2

(12) United States Patent
Matsumoto

(10) Patent No.: US 9,336,766 B2
(45) Date of Patent: May 10, 2016

(54) MUSICAL PERFORMANCE DEVICE FOR GUIDING A MUSICAL PERFORMANCE BY A USER AND METHOD AND NON-TRANSITORY COMPUTER-READABLE STORAGE MEDIUM THEREFOR

(71) Applicant: CASIO COMPUTER CO., LTD., Shibuya-ku, Tokyo (JP)

(72) Inventor: Mitsuhiro Matsumoto, Higashimurayama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 99 days.

(21) Appl. No.: 14/210,384

(22) Filed: Mar. 13, 2014

(65) Prior Publication Data

US 2014/0260907 A1 Sep. 18, 2014

(30) Foreign Application Priority Data

Mar. 14, 2013 (JP) ..... 2013-051138

(51) Int. Cl.
*G10H 7/00* (2006.01)
*G10H 7/02* (2006.01)
*G10H 1/00* (2006.01)

(52) U.S. Cl.
CPC ..... *G10H 7/02* (2013.01); *G10H 1/0066* (2013.01); *G10H 2240/325* (2013.01); *G10H 2250/641* (2013.01)

(58) Field of Classification Search
USPC ..... 84/604
See application file for complete search history.

(56) References Cited

U.S. PATENT DOCUMENTS 6,072,113 A * 6/2000 Tohgi et al. ..... 84/470 R
2011/0283866 A1* 11/2011 Hogan ..... G09B 15/003 84/470 R
2012/0255424 A1* 10/2012 Matsumoto ..... 84/611
2013/0174718 A1* 7/2013 Maruyama ..... G10H 5/00 84/624

FOREIGN PATENT DOCUMENTS

JP 2012-220593 A 11/2012

* cited by examiner

*Primary Examiner* — Christopher Uhlir
(74) *Attorney, Agent, or Firm* — Holtz, Holtz & Volek PC

(57) ABSTRACT

In the present invention, a CPU obtains in advance a loop period LP corresponding to the beat (minimum note length) of a musical piece from musical performance data. In a case where key pressing is not performed even when the key-press timing of a guided key is reached, the CPU sets a loop start point in musical-piece waveform data in accordance with the obtained loop period LP, and instructs a sound source to perform the loop replay of the musical-piece waveform data from the set loop start point to an end address.

9 Claims, 15 Drawing Sheets

WHEN KEY PRESSING IS QUICK

WHEN NO KEY IS PRESSED

WHEN KEY PRESSING IS DELAYED

MUSICAL PERFORMANCE DEVICE FOR GUIDING A MUSICAL PERFORMANCE BY A USER AND METHOD AND NON-TRANSITORY COMPUTER-READABLE STORAGE MEDIUM THEREFOR

CROSS-REFERENCE TO RELATED APPLICATION

This application is based upon and claims the benefit of priority from the prior Japanese Patent Application No. 2013-051138, filed Mar. 14, 2013, the entire contents of which are incorporated herein by reference.

BACKGROUND OF THE INVENTION

1. Field of the Invention

The present invention relates to a musical performance device, a musical performance method, and a storage medium for performing automatic accompaniment by synchronizing accompaniment sound obtained by audio replay with musical sound generated in response to a musical performance operation.

2. Description of the Related Art

A device has been known which performs automatic accompaniment by synchronizing accompaniment sound obtained by audio replay with musical sound generated in response to a musical performance operation. As this type of device, a technology is disclosed in Japanese Patent Application Laid-Open (Kokai) Publication No. 2012-220593 in which a lesson function is provided for guiding a user to a key to be played next based on musical performance data and waiting until the guided key is pressed, and the audio replay of accompaniment sound (audio waveform data) is performed in synchronization with musical sound generated in response to the press of the key guided by this lesson function.

In the technology disclosed in Japanese Patent Application Laid-Open (Kokai) Publication No. 2012-220593, the progression of a musical piece (read of musical performance data) is stopped until a guided key is pressed. Here, if accompaniment sound obtained by audio replay is also stopped, the sound is interrupted, which causes unnaturalness. Therefore, until the guided key is pressed, the accompaniment sound (audio waveform data) which is being emitted in synchronization with the previous key press is loop-replayed and continuously emitted as accompaniment sound during standby.

Specifically, a search is made for a loop start point (zero-cross point in the same phase) of accompaniment sound (audio waveform data) corresponding to the pitch of the guided key, and the accompaniment sound (audio waveform data) from the corresponding loop start point (loop address) to an end address is repeatedly replayed. As a result of this configuration, the audio replay of accompaniment sound with a natural musical interval can be performed even during standby for key press.

However, in a case where the accompaniment sound (audio waveform data) is rhythmical, not only changes in the musical interval but also changes (attenuation) in the waveform amplitude are large. Therefore, when the accompaniment sound is loop-replayed, beats in that period become conspicuous. That is, there is a problem in that the audio replay of accompaniment sound with a natural beat cannot be performed during standby for key press.

SUMMARY OF THE INVENTION

The present invention has been conceived in light of the above-described problem. An object of the present invention is to provide a musical performance device, a musical performance method, and a program by which the audio replay of accompaniment sound with a natural beat can be performed during standby for key press.

In order to achieve the above-described object, in accordance with one aspect of the present invention, there is provided a musical performance device comprising: a guide section which guides a user to at least timing of a musical performance operation to be performed next, based on musical performance data representing a musical piece, and waits until the guided musical performance operation is performed even after the timing of the musical performance operation is reached; an audio replay section which performs audio replay of musical-piece waveform data prepared in advance as accompaniment sound in synchronization with musical sound generated in response to the musical performance operation guided by the guide section; a loop period obtaining section which obtains a loop period corresponding to a beat of the musical piece from the musical performance data; a loop start point setting section which sets a loop start point in the musical-piece waveform data in accordance with the loop period obtained by the loop period obtaining section in a case where the musical performance operation is not performed when the timing of the musical performance operation guided based on the guide section is reached; and a loop replay section which performs loop replay of the musical-piece waveform data from the loop start point set by the loop start point setting section to a loop end point of the musical-piece waveform data.

In accordance with another aspect of the present invention, there is provided a musical performance method for use in a musical performance device, comprising: a step of guiding a user to at least timing of a musical performance operation to be performed next, based on musical performance data representing a musical piece, and waiting until the guided musical performance operation is performed even after the timing of the musical performance operation is reached; a step of performing audio replay of musical-piece waveform data prepared in advance as accompaniment sound in synchronization with musical sound generated in response to the guided musical performance operation; a step of obtaining a loop period corresponding to a beat of the musical piece from the musical performance data; a step of setting a loop start point in the musical-piece waveform data in accordance with the obtained loop period in a case where the musical performance operation is not performed when the timing of the guided musical performance operation is reached; and a step of performing loop replay of the musical-piece waveform data from the set loop start point to a loop end point of the musical-piece waveform data.

In accordance with another aspect of the present invention, there is provided a non-transitory computer-readable storage medium having stored thereon a program that is executable by a computer, the program being executable by the computer to perform functions comprising: guide processing for guiding a user to at least timing of a musical performance operation to be performed next, based on musical performance data representing a musical piece, and waiting until the guided musical performance operation is performed even after the timing of the musical performance operation is reached; audio replay processing for performing audio replay of musical-piece waveform data prepared in advance as accompaniment sound in synchronization with musical sound generated in response to the guided musical performance operation; loop period obtaining processing for obtaining a loop period corresponding to a beat of the musical piece from the musical performance data; loop start point setting processing for setting a loop start point in the musical-piece waveform data in accordance with the obtained loop period in a case where the musical performance operation is not performed when the timing of the guided musical performance operation is reached; and loop replay processing for performing loop replay of the musical-piece waveform data from the set loop start point to a loop end point of the musical-piece waveform data.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

An embodiment of the present invention will hereinafter be described with reference to the drawings.

A. Structure

Figure 1:
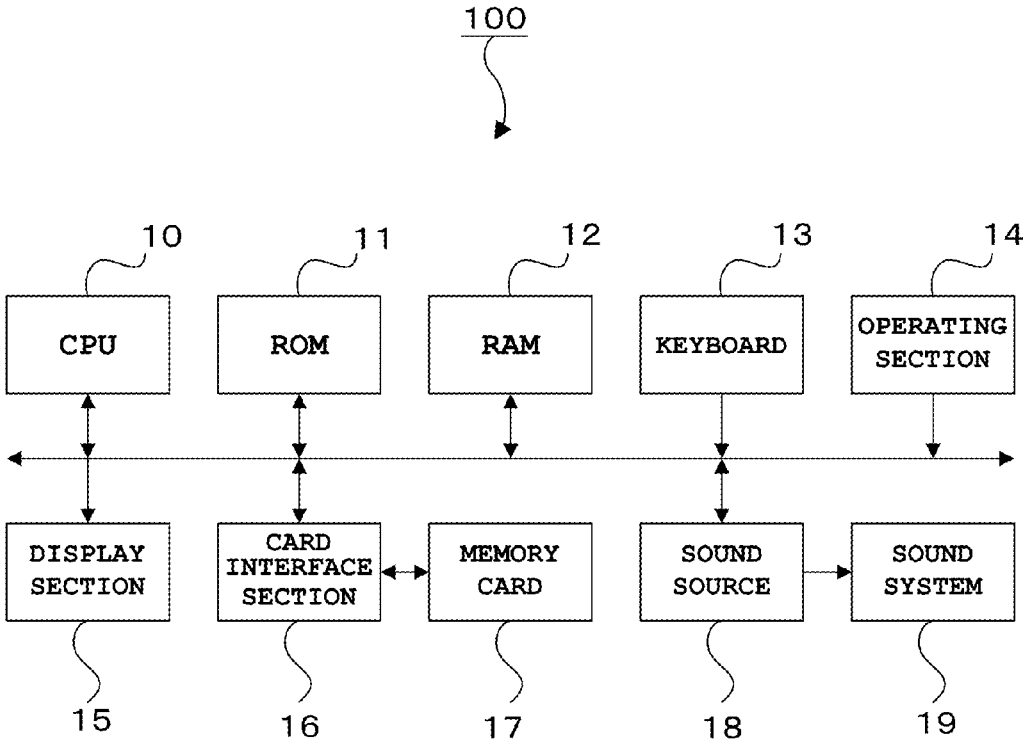
FIG. 1 is a block diagram depicting the entire structure of a musical performance device 100 according to an embodiment.

FIG. 1 is a block diagram depicting the entire structure of a musical performance device 100 according to an embodiment of the present invention. A CPU 10 in FIG. 1 sets the operation status of each section of the device based on an operation event that occurs in response to a switch operation of an operating section 14, and instructs a sound source 18 to generate a musical sound based on musical performance information generated by a keyboard 13 in response to a user's musical performance operation (a key pressing/releasing operation).

Also, the CPU 10 provides a lesson function for guiding a user to a key to be pressed next based on musical performance data (which will be described further below) and waiting until the guided key is pressed. Furthermore, the CPU 10 performs the audio replay of accompaniment sound with a natural beat when waiting for a guided key to be pressed while performing an automatic accompaniment function for performing the audio replay of accompaniment sound (musical-piece waveform data) in synchronization with musical sound generated in response to the press of a key guided by the lesson function. The processing operation of the CPU 10 related to the gist of the present invention is described in detail further below.

In a ROM 11 in FIG. 1, various control programs to be loaded to the CPU 10 are stored. These control programs include programs for the main routine, timer interrupt processing, keyboard processing, song processing, and sound source sound-emission processing. The song processing includes song start processing and song replay processing.

Figure 2:
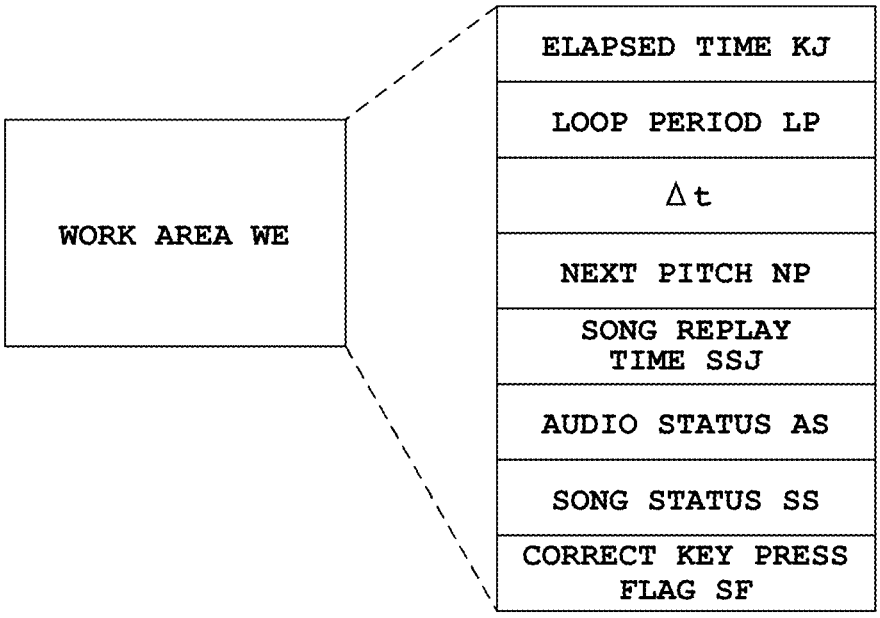
FIG. 2 is a memory map depicting the structure of a work area WE of a RAM 12.

The RAM 12 includes a work area WE which temporarily stores various register and flag data for use in processing by the CPU 10. In this work area WE, an elapsed time KJ, a loop period LP, Δt, a next pitch NP, a song replay time SSJ, an audio status AS, a song status SS, and a correct key press flag SF are temporarily stored as depicted in FIG. 2. The objective of the register and flag data will be described further below.

The keyboard 13 generates musical performance information constituted by a key-ON/key-OFF signal according to a key pressing/releasing operation (musical performance operation), a key number (or a note number), velocity, and the like, and supplies it to the CPU 10. The musical performance information supplied to the CPU 10 is converted by the CPU 10 to a note event and supplied to the sound source 18.

The operating section 14, which is constituted by various switches arranged on a console panel (not depicted in the drawings), generates a switch event corresponding to an operated switch, and supplies it to the CPU 10. As the main switch related to the gist of the present invention, the operating section 14 includes a song switch for instructing to start or end song replay (automatic accompaniment). The song switch is a switch that is alternately set ON or OFF for each pressing operation. The ON-setting represents song start (song replay) and the OFF-setting represents song end (stop of song replay).

A display section 15 in FIG. 1 is constituted by an LCD panel and a driver, and displays the setting or operation status of the device in response to a display control signal supplied from the CPU 10, or displays a lesson screen. The lesson screen is displayed when the CPU 10 is performing the lesson function. Specifically, the display section 15 displays a keyboard image on a screen, and highlights a key thereon specified by musical performance data (which will be described further below) of melody sound to be performed next, whereby the user is guided to the position of the key to be played next and informed of key press timing therefor.

Figure 3:
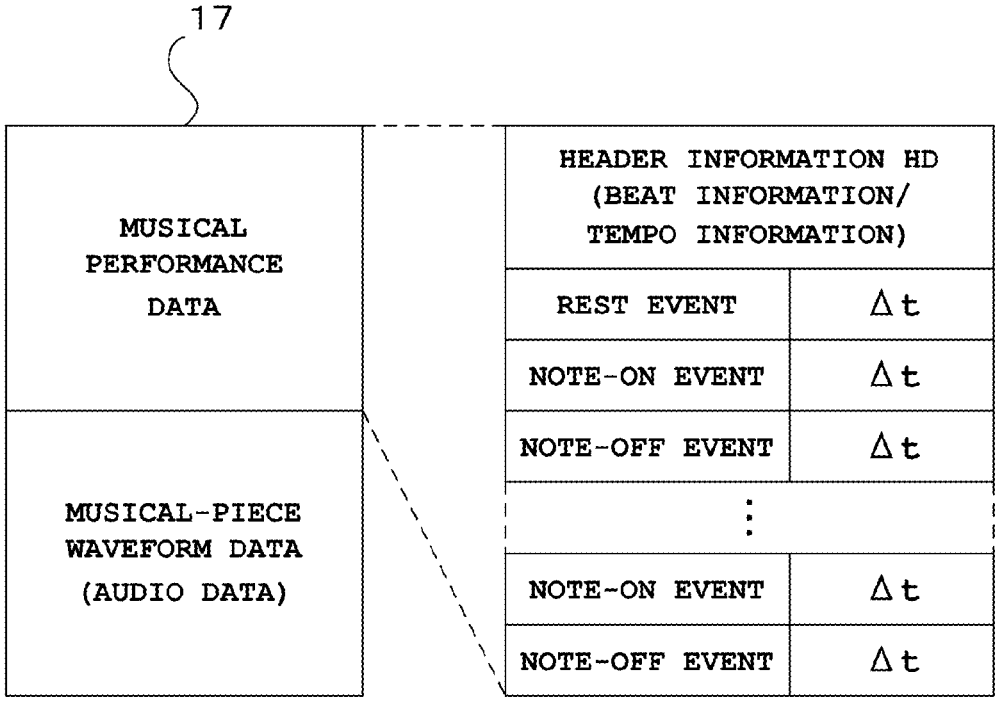
FIG. 3 is a memory map depicting the structure of musical performance data (song data) and musical-piece waveform data (audio data) stored in a memory card 17.

A card interface section 16 in FIG. 1 follows an instruction from the CPU 10 to read out musical performance data or musical-piece waveform data (audio data) stored in the memory card 17 and transfer it to the work area WE of the RAM 12 and the sound source 18. In the memory card 17, musical performance data and musical-piece waveform data (audio data) are stored, as depicted in FIG. 3. This musical performance data is constituted by header information HD and a MIDI event. The header information HD includes beat information corresponding to a minimum note length included in a musical piece for automatic accompaniment and tempo information indicating the tempo of the musical piece.

The MIDI event represents each note (melody sound) forming a melody part of a musical piece for automatic accompaniment.

Following a rest event representing a section corresponding to an introduction at the head of a musical piece, the MIDI event is provided corresponding to each note forming a melody part of the musical piece with a note-on event (Δt) representing a pitch to be emitted and its timing and a note-off event (Δt) representing a pitch to be muted and its timing as one set. Δt is an elapsed time (tick count) from a previous event, representing the start timing of a current event.

Figure 4:
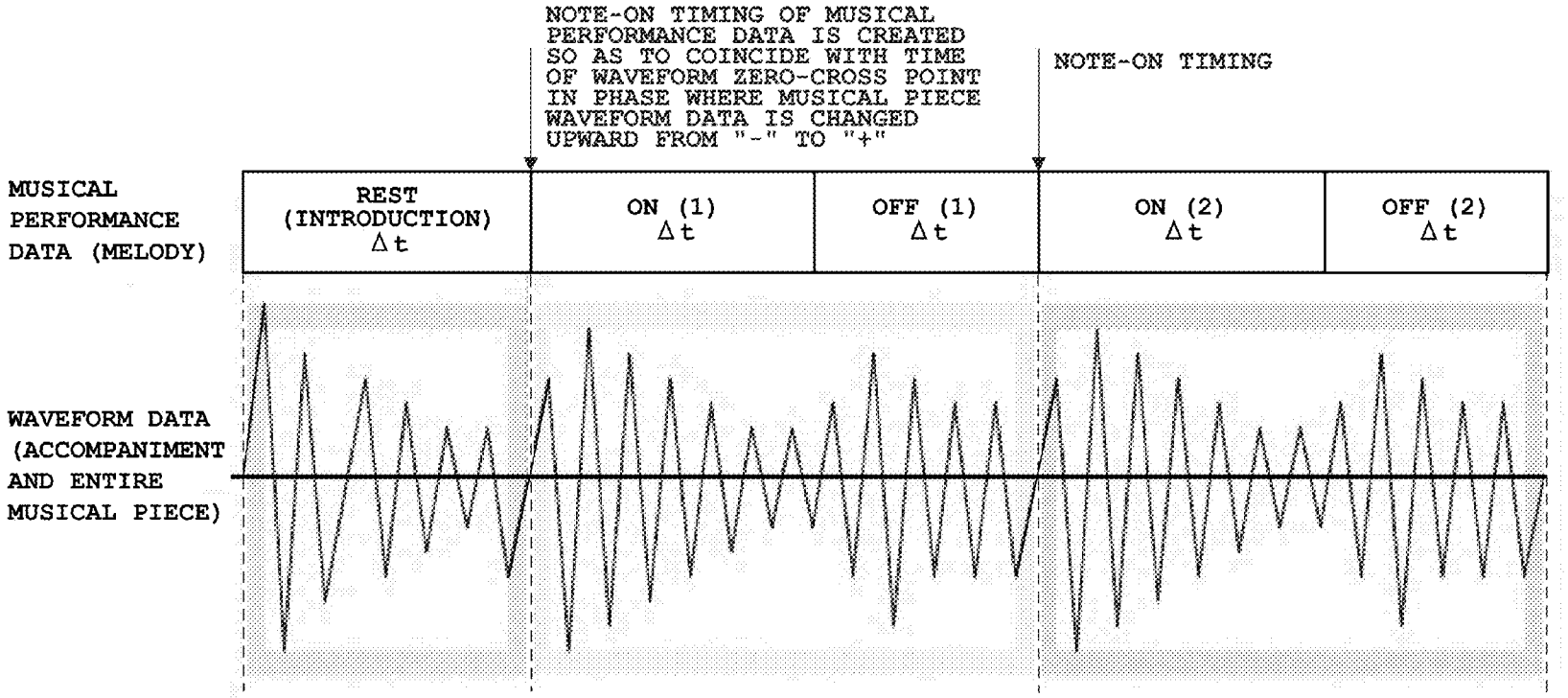
FIG. 4 is a diagram for describing a relation between musical performance data and musical-piece waveform data.

The musical-piece waveform data (audio data) is, for example, time-series audio data obtained by accompaniment sound including musical performance sound of an accompaniment part and musical performance sound of another part being subjected to PCM sampling. Here, a correspondence between the musical performance data and the musical-piece waveform data is described with reference to FIG. 4. In the drawing, the upper part represents the musical performance data, and the lower part represents the musical-piece waveform data. The note-on timing of the musical performance data is created so as to coincide with the time of a waveform zero-cross point in a phase where the musical-piece waveform data is changed upward from "−" to "+".

The structure of the present embodiment is further described with reference to FIG. 1 again. The sound source 18 in FIG. 1 is structured by a known waveform memory read method, and includes a plurality of sound-emission channels which operates time-divisionally. In the sound source 18, by following an instruction from the CPU 10, musical sound of melody sound is generated in response to the press of a key guided by the lesson function, and the audio replay of accompaniment sound (musical-piece waveform data) is performed in synchronization with this melody sound. Until a guided key is pressed, the audio replay of accompaniment sound with a natural beat is performed. A sound system 19 in FIG. 1 performs D/A conversion of an output from the sound source 18 to an analog musical sound signal and then amplifies the resultant signal for sound emission from a loudspeaker.

Figure 5A:
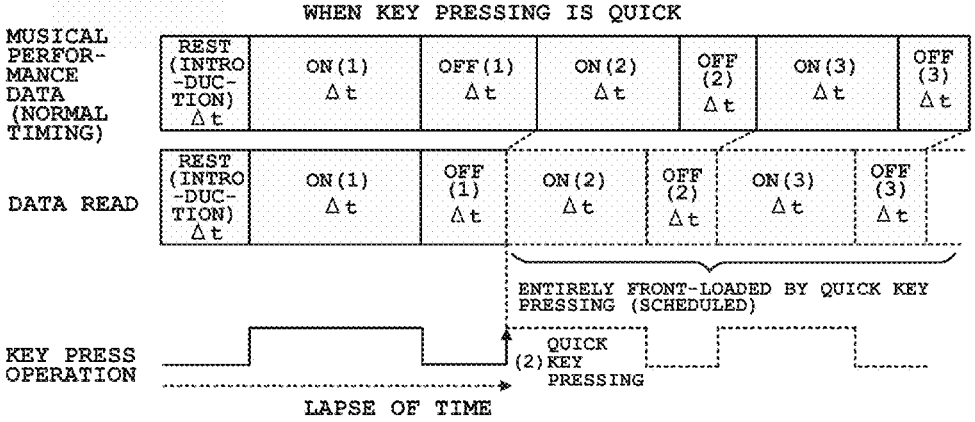
FIGS. 5A-5C are diagrams for describing a lesson function in the present embodiment.
Figure 5B:
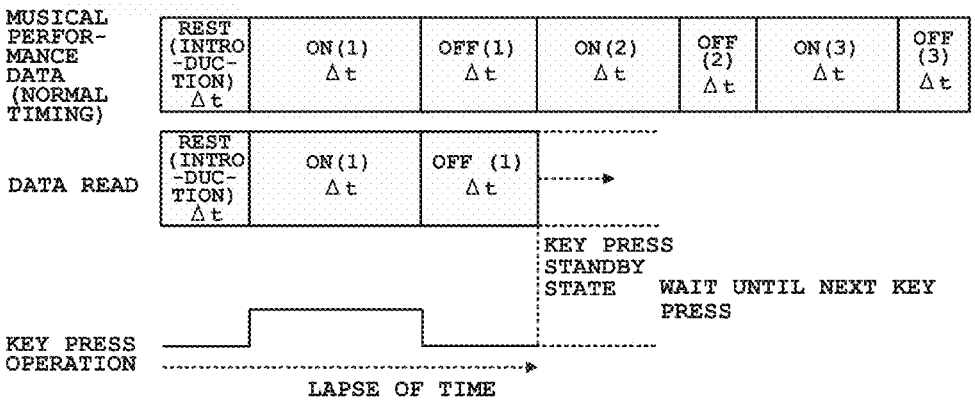
Figure 5C:
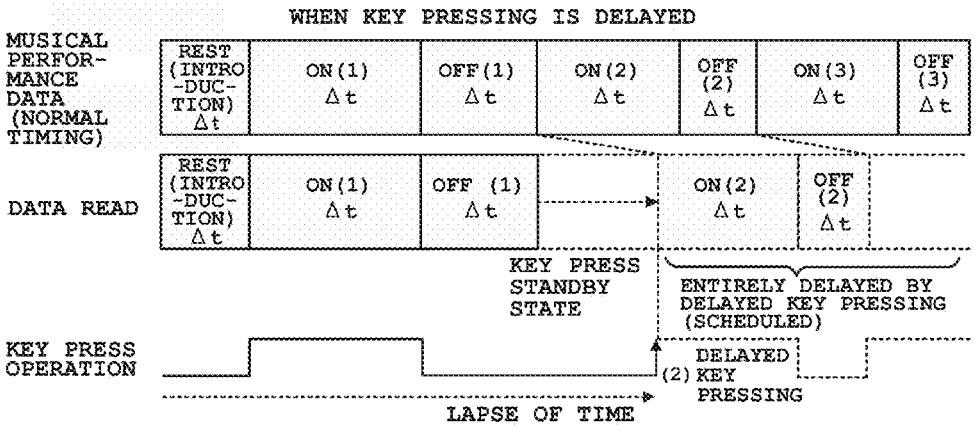

Next, musical performance data read modes by the lesson function of the CPU 10 are described with reference to FIG. 5A to FIG. 5C. FIG. 5A to FIG. 5C depict musical performance data read modes, of which FIG. 5A depicts a case where user's key pressing is quick with respect to normal timing defined by musical performance data (press key timing of a note-on event ON (2)), FIG. 5B depicts a case where no key is pressed, and FIG. 5C depicts a case where user's key pressing is slow.

First, when key pressing for a head sound is performed at normal timing defined by musical performance data, and a key for the following second sound is pressed at timing earlier than the normal timing as depicted in FIG. 5A, this key press timing is updated to the timing of note-on ON (2) of the second sound, and all event timing thereafter are also updated by the quick key pressing and front-loaded all in all.

When key pressing is not performed for the second sound as depicted in FIG. 5B, the progress of the musical piece stops at that moment, and continuously waits until a key is pressed. When key pressing is performed for the second sound at timing later than the normal timing as depicted in FIG. 5C, this late key press timing is updated to the timing of note-on ON (2) of the second sound, and all event timing thereafter are also updated by the slow key pressing and delayed all in all.

B. Operation

Next, the operation of the above-structured musical performance device 100 is described with reference to FIG. 6 to FIG. 12. In the following descriptions, operations of the main routine, the timer interrupt processing, the keyboard processing, the song processing (including the song start processing and the song replay processing), the sound source sound-emission processing, and other processing are respectively explained, in which the CPU 10 of the musical performance device 100 serves as an operation subject.

(1) Operation of Main Routine

Figure 6:
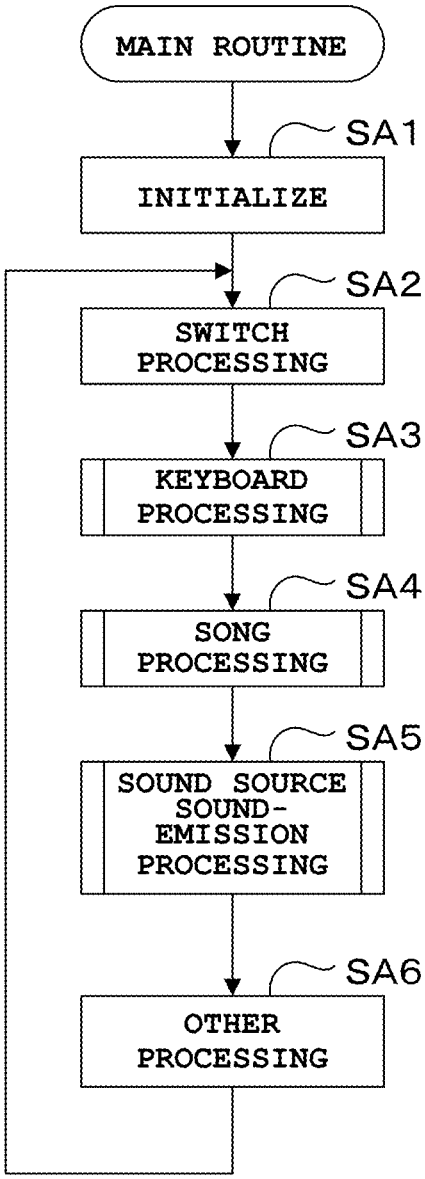
FIG. 6 is a flowchart of the operation of the main routine.

When the musical performance device 100 is powered on by a power supply switch operation, the CPU 10 starts the main routine depicted in FIG. 6 to proceed to Step SA1, and performs the initialization of each section of the device. When the initialization is completed, the CPU 10 proceeds to the next Step SA2, and performs switch processing based on a switch event generated corresponding to an operated switch by the operating unit 14. For example, in response to an operation of pressing a song switch, the CPU 10 sets a state in which a song is being replayed (automatic accompaniment is being played) or a state in which the song is stopped.

Subsequently, keyboard processing is performed at Step SA3. In the keyboard processing, as will be described further below, the CPU 10 instructs the sound source 18 to emit and mute the musical sound of the pitch of a pressed or released key. Also, when key pressing is performed during song replay (during automatic accompaniment), the CPU 10 judges whether the key pressing is correct and the pitch of the pressed key coincides with the next pitch NP. When judged that the key pressing is correct, the CPU 10 judges whether the key pressing has been performed at timing earlier than normal timing before loop replay or at timing later than the normal timing during loop replay (in a key press standby state). Note that this normal timing represents event timing defined by musical performance data.

Then, when judged that the key pressing has been performed at timing earlier than the normal timing, the CPU 10 finds, in musical-piece waveform data for normal replay, a waveform zero-cross point that is closest to the key pressing time point and in a phase where a change is made from "−" to "+", and obtains the time of the waveform zero-cross point as a jump-origin time for waveform connection. On the other hand, when judged that the key pressing has been performed at timing later than the normal timing during loop replay (in a key press standby state), the CPU 10 finds, in musical-piece waveform data for loop replay, a waveform zero-cross point that is closest to the key pressing time point and in a phase where a change is made from "−" to "+", and obtains the time of the waveform zero-cross point as a jump-origin time for waveform connection.

Next, song processing is performed at Step SA4. In the song processing, as will be described further below, when a song start state is set by a song switch operation, the CPU 10 sets, as preparation for the start of song replay (automatic accompaniment), the loop period LP obtained based on beat information and tempo information included in the header information HD of the musical performance data, Δt corresponding to an initial rest event, and the next pitch NP of a key that is guided first, in the work area WE of the RAM 12. Next, the CPU 10 resets the song replay time SSJ to zero to start the measurement of the song replay time SSJ by timer interrupt processing, and instructs the sound source 18 to start audio replay to replay an introduction portion of the musical piece. In response to this, the CPU 10 sets the audio status AS to normal replay and the song status SS to "during song replay".

Then, after song replay (automatic accompaniment) is started and during the audio normal replay of the musical-piece waveform data, when the guided key of the next pitch NP is pressed earlier than the normal timing defined by the musical performance data, the CPU 10 updates the song replay time SSJ to a jump-destination time (note-on event time of the next musical performance data) as soon as the jump-origin time is reached. In addition, the CPU 10 updates the next pitch NP and Δt based on the next musical performance data, and instructs the sound source 18 to perform audio normal replay from the jump-destination time.

When the guided key of the next pitch NP is pressed during the loop replay of the musical-piece waveform data, the CPU 10 instructs the sound source 18 to cancel the audio loop replay as soon as the jump-origin time is reached, updates the song replay time SSJ to the jump-destination time (note-on event time of the next musical performance data), updates the next pitch NP and Δt based on the next musical performance data, and instructs the sound source 18 to perform audio normal replay from the jump-destination time.

When key pressing is not performed even after the next event timing is reached, the CPU 10 sets a loop start point so as to coincide with the loop period LP corresponding to the beat (minimum note length) of the musical piece, and performs the audio loop replay of the musical-piece waveform data from the set loop start point to the previous event completion time point P. Accordingly, until the guided key is pressed, the loop replay of accompaniment sound with a natural beat is performed.

Subsequently, sound source sound-emission processing is performed at Step SA5. In the sound source sound-emission processing, as will be described further below, the CPU 10 judges whether loop replay is being performed. If loop replay is not being performed, the CPU 10 performs the audio normal replay of the musical-piece waveform data according to the song replay time SSJ. Conversely, if loop replay is being performed, the CPU 10 performs the loop replay of the musical-piece waveform data with the song replay time SSJ being stopped. Thereafter, the CPU 10 generates musical sound by MIDI replay according to musical performance information generated by the key pressing/releasing operation of the keyboard 13, and ends the processing.

Then, at Step SA6, the CPU 10 causes a keyboard image to be displayed on the screen of the display unit 15, and performs, as other processing, a lesson function for highlighting a key specified for melody sound (musical performance data) to be played next, guiding the user to the position of the key to be played next, and informing the user of the key press timing. Then, the CPU 10 returns the processing to Step SA2. Thereafter, the CPU 10 repeatedly performs Steps SA2 to SA6 until the musical performance device 100 is powered off.

(2) Operation of Timer Interrupt Processing

Figure 7:
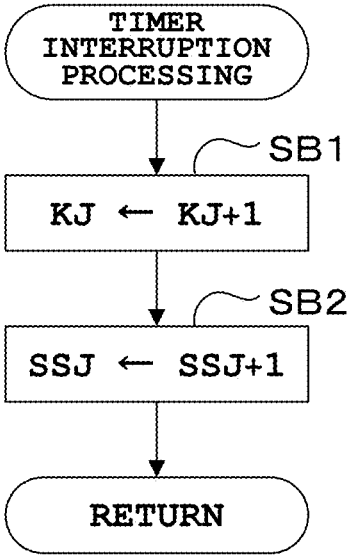
FIG. 7 is a flowchart of the operation of timer interrupt processing.

Next, the operation of timer interrupt processing is described with reference to FIG. 7. In the CPU 10, timer interrupt processing is started simultaneously with the execution of the above-described main routine. When interrupt timing of this processing comes, the CPU 10 proceeds to Step SB1 depicted in FIG. 7 and increments the elapsed time KJ. In the subsequent Step SB2, the CPU 10 increments the song replay time SSJ, and ends the processing. Note that the operation of this processing is temporarily prohibited by an interrupt mask at Step SF17 of song replay processing, which will be described further below (refer to FIG. 12).

(3) Operation of Keyboard Processing

Next, the operation of the keyboard processing is described with reference to FIG. 8 to FIG. 9. When this processing is started via Step SA3 (refer to FIG. 6) of the above-described main routine, the CPU 10 proceeds to Step SCI depicted in FIG. 8, and performs keyboard scanning for detecting a key change for each key on the keyboard 13. Subsequently, at Step SC2, the CPU 10 judges, based on the key scanning result at Step SC1, whether a key operation has been performed. When judged that a key operation has not been performed, the judgment result herein is "NO", and therefore the CPU 10 ends the processing.

Conversely, when judged that a key operation has been performed, that is, when judged that a key on the keyboard 13 has been pressed or released, the judgment result at Step SC2 is "YES", and therefore the CPU 10 proceeds to Step SC3. At Step SC3, the CPU 10 judges whether the song status SS is "1", that is, a song is being replayed (automatic accompaniment is being played). When judged that a song is not being replayed (the song status SS is "0"), since the judgment result is "NO", the CPU 10 proceeds to Step SC4. At Step SC4, the CPU 10 performs normal keyboard processing for sending a note-on event created in response to the key press operation to the sound source 18 to emit the musical sound of the pitch of the pressed key or sending a note-off event created in response to the key release operation to the sound source 18 to mute the musical sound of the pitch of the released key, and ends the processing.

At Step SC3, when the song status SS is "1" indicating that a song is being replayed, since the judgment result at Step SC3 is "YES", the CPU 10 performs lesson keyboard processing at Steps SC5 to SC11. At Step SC5, the CPU 10 judges, based on a key event generated by the key operation, whether the key operation is a key pressing operation or a key releasing operation.

When judged that the key operation is a key releasing operation, the judgment result at Step SC5 is "NO", and therefore the CPU 10 proceeds to Step SC12, and instructs the sound source 18 to mute the musical sound of the pitch of the released key, as in the case of the normal keyboard processing (Step SC4). When judged that the key operation is a key pressing operation, the judgment result at Step SC5 is "YES", and therefore the CPU 10 proceeds to Step SC6, and instructs the sound source 18 to emit the musical sound of the pitch of the pressed key. As a result, the sound source 18 emits the musical sound of the pitch of the pressed key or mutes the musical sound of the pitch of the released key according to the key pressing/releasing operation.

Next, at Step SC7, the CPU 10 judges whether the pitch of the pressed key coincides with the next pitch NP (the pitch of musical performance data to be played next) that is guided based on the lesson function. When the pitch of the pressed key does not coincide with the next pitch NP and erroneous key pressing has been performed, the judgment result is "NO", and therefore the CPU 10 once ends the processing. When the pitch of the pressed key coincides with the next pitch NP and correct key pressing has been performed, the judgment result at Step SC7 is "YES", and therefore the CPU 10 proceeds to Step SC8.

At Step SC8, the CPU 10 sets the correct key press flag at "1", indicating that the guided key has been correctly pressed. Next, at Step SC9, the CPU 10 judges whether loop replay is being performed, that is, whether the key pressing has been performed at timing earlier than the normal timing before loop replay or at timing later than the normal timing during loop replay. Note that the normal timing herein is note-on timing defined by the musical performance data.

When judged that the key pressing has been performed at timing earlier than the normal timing, the judgment result at Step SC9 is "NO", and therefore the CPU 10 proceeds to Step SC10. At Step SC10, for example, when the guided key has been pressed at timing earlier than the normal timing of note-on event ON (1) as in an example depicted in FIG. 9, the CPU 10 finds, in the musical-piece waveform data (introduction portion) during audio normal replay, a waveform zero-cro point closest to the key pressing time point in a phase where a change is made from "−" to "+", and obtains the time of the waveform zero-cross point as a jump-origin time for waveform connection, and then ends the processing. The obtained jump-origin time is referred to in song replay processing described below.

At Step SC9, when judged that the key pressing has been performed at timing later than the normal timing during loop replay, the judgment result at Step SC9 is "YES", and therefore the CPU 10 proceeds to Step SC11. At Step SC11, as in the case of Step SC10, the CPU 10 finds, in the musical-piece waveform data during loop replay, a waveform zero-cross point closest to the key pressing time point in a phase where a change is made from "−" to "+", and obtains the time of the waveform zero-cross point as a jump-origin time for waveform connection, and then ends the processing.

As such, in the keyboard processing, the CPU 10 instructs the sound source 18 to emit or mute the musical sound of the pitch of a pressed or released key. Also, when key pressing is performed during song replay, the CPU 10 judges whether the key pressing is correct and the pitch of the pressed key coincides with the next pitch NP. When judged that the key pressing is correct, the CPU 10 judges whether the key pressing has been performed at timing earlier than the normal timing before loop replay or at timing later than the normal timing during loop replay.

Then, when judged that the key pressing has been performed at timing earlier than the normal timing, the CPU 10 finds, in the musical-piece waveform data for audio normal replay, a waveform zero-cross point that is closest to the key pressing time point and in a phase where a change is made from "−" to "+", and obtains the time of the waveform zero-cross point as a jump-origin time for waveform connection. When judged that the key pressing has been performed at timing later than the normal timing during loop replay, the CPU 10 finds, in the musical-piece waveform data for loop replay, a waveform zero-cross point that is closest to the key pressing time point and in a phase where a change is made from "−" to "+", and obtains the time of the waveform zero-cross point as a jump-origin time for waveform connection.

(4) Operation of Song Processing

Figure 10:
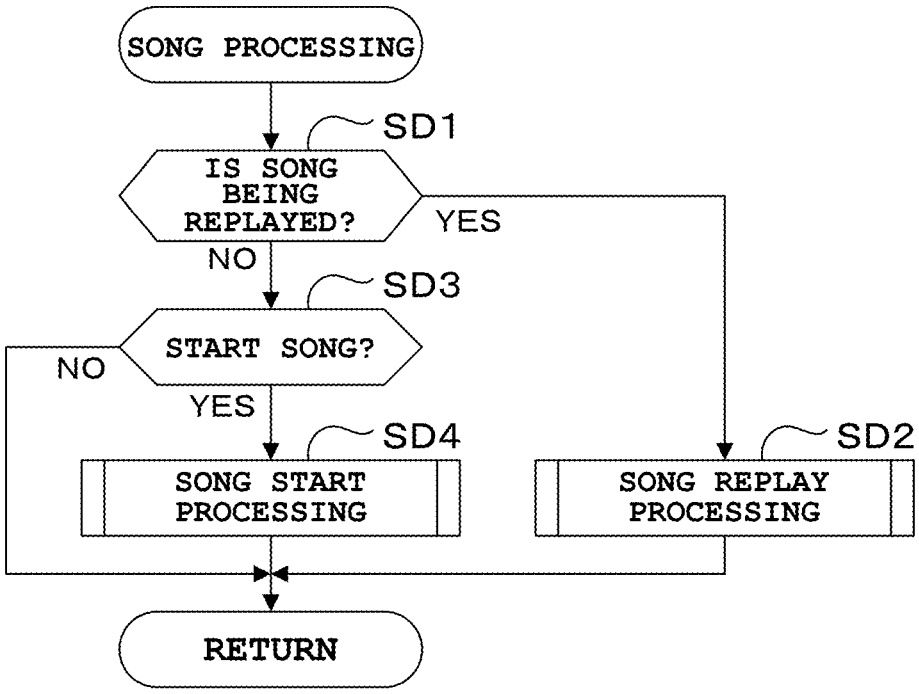
FIG. 10 is a flowchart of the operation of song processing.

Next, the operation of the song processing is described with reference to FIG. 10. When this processing is started via Step SA4 (refer to FIG. 6) of the above-described main routine, the CPU 10 proceeds to Step SD1 depicted in FIG. 10, and judges whether the song status SS is "1" indicating "during song replay (during automatic accompaniment)". When the song status SS is "during song replay (during automatic accompaniment)", the judgment result is "YES", and therefore the CPU 10 performs song replay processing (which will be described further below) via Step SD2.

On the other hand, when the song status SS is "0" indicating "during song stop", the judgment result at Step SD1 is "NO", and therefore the CPU 10 proceeds to Step SD3, and judges whether song start (song replay) has been set by a song switch operation. When judged that song start (song replay) has not been set, the judgment result is "NO", and therefore the CPU 10 ends the processing. When judged that song start (song replay) has been set by a song switch operation, the judgment result at Step SD3 is "YES", and therefore the CPU 10 performs song start processing described below via Step SD4.

(5) Operation of Song Start Processing

Figure 11:
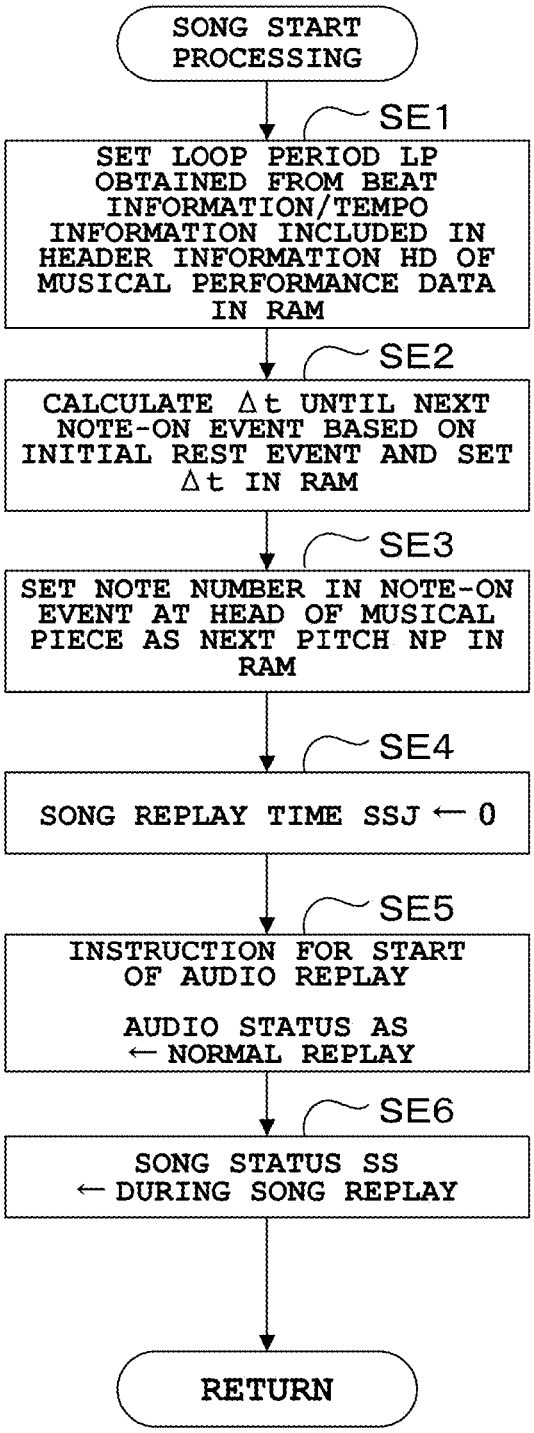
FIG. 11 is a flowchart of the operation of song start processing.

Next, the operation of the song start processing is described with reference to FIG. 11. When this processing is started via Step SD4 (refer to FIG. 10) of the above-described song processing, the CPU 10 proceeds to Step SE1 depicted in FIG. 11, and sets the loop period LP obtained from the beat information and the tempo information included in the header information HD of the musical performance data in the work area WE of the RAM 12 (refer to FIG. 2). For example, when the beat information corresponding to the minimum note length of the musical piece for automatic accompaniment indicates eight beats (an eighth note) and the tempo information indicating the tempo of the musical piece is 120 bpm, the loop period LP corresponding to an eighth note length is 250 msec.

Subsequently, at Step SE2, the CPU 10 calculates Δt (elapsed time) until the next note-on event based on the initial rest event of the musical performance data, and sets Δt in the work area WE of the RAM 12. Next, at Step SE3, the CPU 10 reads a note number (pitch) included in a note-on event at the head of the musical piece from the musical performance data stored in the card memory 17, and sets this note number as the next pitch NP the pitch of the key guided first) in the work area WE of the RAM 12.

Then, the CPU 10 proceeds to Step SE4, and sets the song replay time SSJ to zero. As a result, the measurement of the song replay time SSJ is started by the above-described timer interrupt processing. At Steps SE5 and SE6, along with the start of the measurement of the song replay time SSJ, the CPU 10 instructs the sound source 18 to start audio replay, sets the audio status AS to normal replay, sets a flag value of "1" indicating "during song replay" to the song status SS, and ends the processing. In the sound source 18, by following the instruction to start audio replay from the CPU 10, the musical-piece waveform data is sequentially read out from the memory card 17 to replay the introduction portion of the musical piece.

As such, in the song start processing, as preparation for staring song replay (automatic accompaniment), the CPU 10 sets the loop period LP obtained based on the beat information and the tempo information included in the header information HD of the musical performance data, Δt corresponding to the initial rest event, and the next pitch NP of the key first press-guided in the work area WE of the RAM 12. Then, the CPU 10 sets the song replay time SSJ to zero to start the measurement of the song replay time SSJ by timer interrupt processing. Also, the CPU 10 instructs the sound source 18 to start audio replay to replay the introduction portion of the musical piece, and sets the audio status AS to normal replay and the song status SS to "during song replay" along with it.

(6) Operation of Song Replay Processing

Next, the operation of the song replay processing is described with reference to FIG. 12 to FIG. 14. When this processing is started via Step SD2 (refer to FIG. 10) of the above-described song processing, the CPU 10 proceeds to Step SF1 depicted in FIG. 12, and obtains the elapsed time KJ from the work area WE of the RAM 12. Note that this elapsed time KJ is an elapsed time of a musical piece which is measured by timer interrupt processing (refer to FIG. 7). Subsequently, at Step SF2, the CPU 10 calculates a time (Δt−KJ) by subtracting the elapsed time KJ from the time until the next event.

Subsequently, the CPU 10 judges at Step SF3 whether the time has reached the next event timing based on the time (Δt−KJ). That is, when the time (Δt−KJ) is larger than "0", the CPU 10 judges that the time has not reached the next event timing. On the other hand, when the time (Δt−KJ) is equal to or smaller than "0", the CPU 10 judges that the time has reached the next event timing. In the following, operation in the case where the time has not reached the next event timing and operation in the case where the time has reached the next event timing are described separately.

a. In the Case where the Time has not Reached the Next Event Timing

Figure 13:
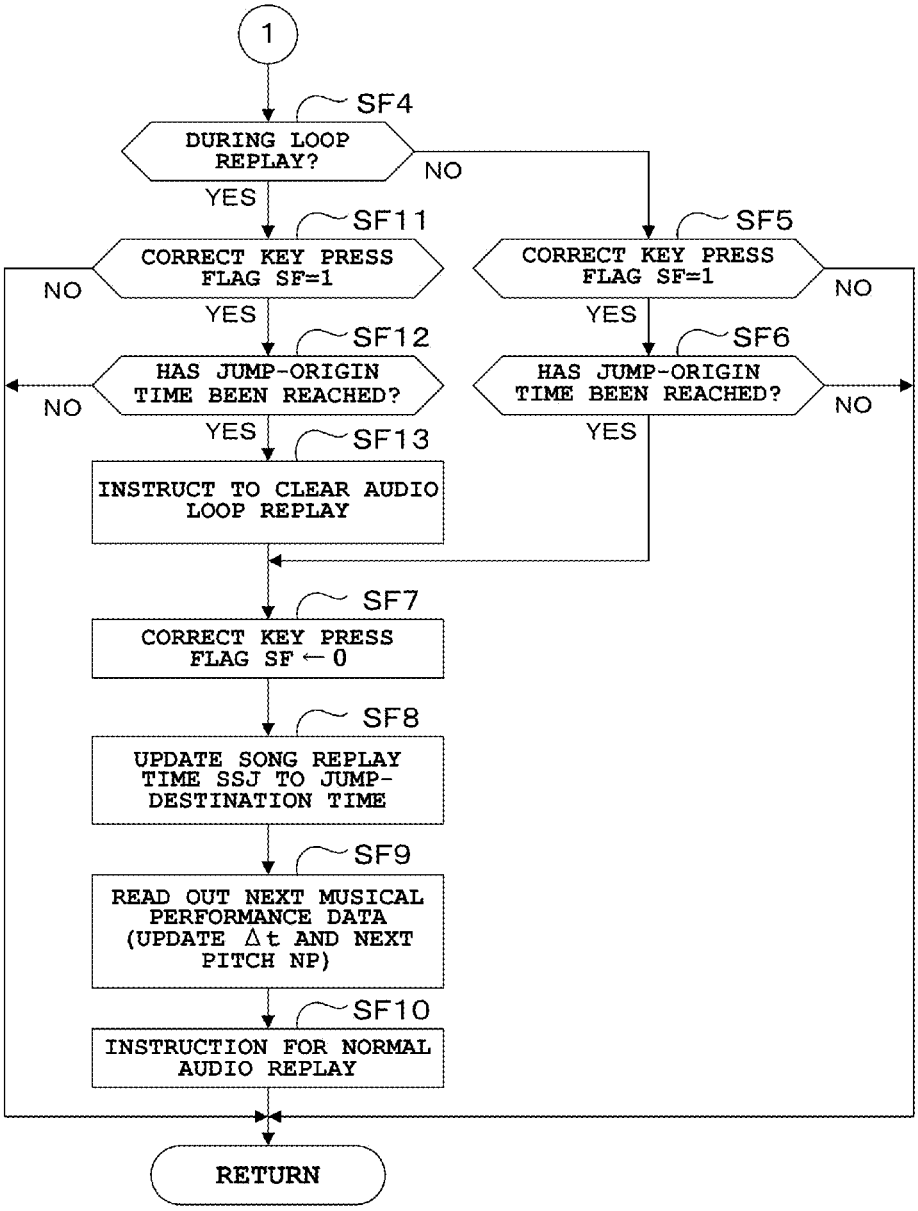
FIG. 13 is a flowchart of the operation of the song replay processing.

When the time (Δt−KJ) is larger than "0" and has not reached the next event timing, since the judgment result at Step SF3 is "NO", the CPU 10 proceeds to Step SF4 depicted in FIG. 13, and judges whether loop replay is being performed, or in other words, judges whether the audio normal replay of the musical-piece waveform data or the audio loop replay of the musical-piece waveform data is being performed. In the following, operation in the case where the audio normal replay of the musical-piece waveform data is being performed and operation in the case where the audio loop replay of the musical-piece waveform data is being performed are described separately.

<When Audio Normal Replay of Musical-Piece Waveform Data is being Performed>

When the audio normal replay of the musical-piece waveform data is being performed, since the judgment result at Step SF4 is "NO", the CPU 10 proceeds to Step SF5, and judges whether the correct key press flag SF is "1", or in other words, the guided key of the next pitch NP has been pressed. When judged that the key of the next pitch NP has not been pressed, the judgment result is "NO", and therefore the CPU 10 ends the processing. In this case, the sound source 18 proceeds to the audio normal replay of the musical-piece waveform data.

On the other hand, when the guided key of the next pitch NP has been pressed at timing earlier than the normal timing defined by the musical performance data during the audio normal replay of the musical-piece waveform data, the judgment result at Step SF5 is "YES", and therefore the CPU 10 proceeds to Step SF6. At Step SF6, the CPU 10 judges whether the time has reached the jump-origin time obtained at Step SC10 of the above-described keyboard processing (refer to FIG. 8).

The jump-origin time is a time obtained as follows. When the guided key is pressed at timing earlier than the normal timing of the musical performance data, in the musical-piece waveform data (an introduction portion) during replay, a waveform zero-cross point that is closest to the key pressing time point and in a phase where a change is made from "−" to "+" is found, and the time of the waveform zero-cross point is obtained as a jump-origin time for waveform connection.

When judged that the time has not reached the jump-origin time, since the judgment result at Step SF6 is "NO", the CPU 10 once ends the processing. Conversely, when judged that the time has reached the jump-origin time, since the judgment result at Step SF6 is "YES", the CPU 10 proceeds to Step SF7, and resets the correct key press flag SF to zero. Next, at Step SF8, the CPU 10 updates the song replay time SSJ to the jump-destination time (note-on event time of the next musical performance data).

Subsequently, at Step SF9, the CPU 10 updates and registers a note number during the note-on event of the next musical performance data read out from the memory card 17 as the next pitch NP in the work area WE of the RAM 12, and also updates and registers Δt of the note-on event in the work area WE of the RAM 12. Then, the CPU 10 proceeds to Step SF10, and instructs the sound source 18 to perform audio normal replay from the jump-destination time.

As such, during the audio normal replay of the musical-piece waveform data, when the guided key of the next pitch NP is pressed at timing earlier than the normal timing defined by the musical performance data, the CPU 10 updates the song replay time SSJ to a jump-destination time (note-on event time of the next musical performance data) as soon as the jump-origin time is reached. In addition, the CPU 10 updates the next pitch NP and Δt based on the next musical performance data, and instructs the sound source 18 to perform audio normal replay from the jump-destination time.

<When Audio Loop Replay of Musical-Piece Waveform Data is Being Performed>

On the other hand, when the audio loop replay of the musical-piece waveform data is being performed, since the judgment result at Step SF4 is "YES", the CPU 10 proceeds to Step SF11, and judges whether the correct key press flag SF is "1", or in other words, judges whether the guided key of the next pitch NP has been pressed. When judged that the guided key of the next pitch NP has not been pressed, since the judgment result is "NO", the CPU 10 ends the processing. In this case, the sound source 18 continues the loop replay of the musical-piece waveform data while the key press standby state continues.

Figure 8:
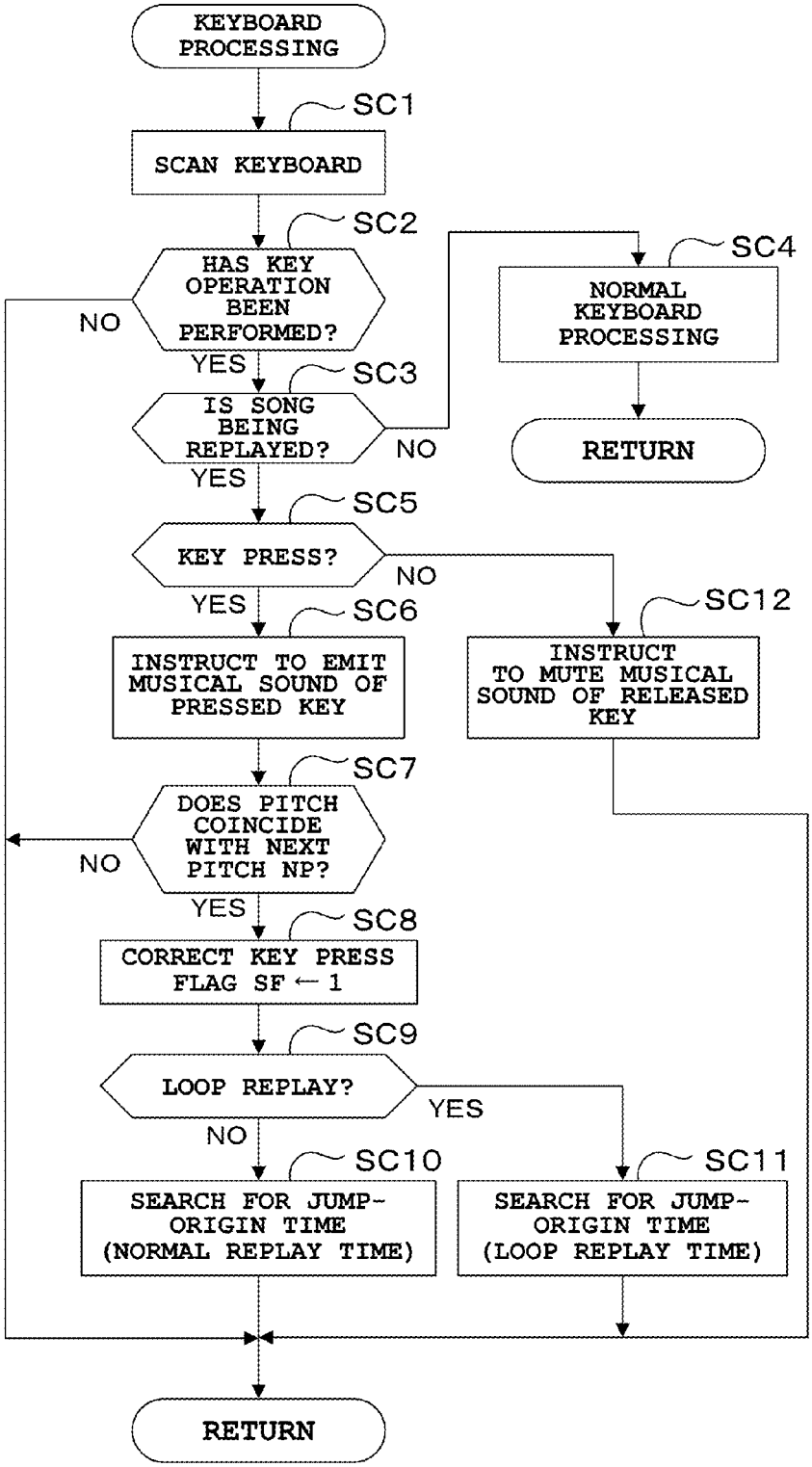
FIG. 8 is a flowchart of the operation of keyboard processing.
Figure 9:
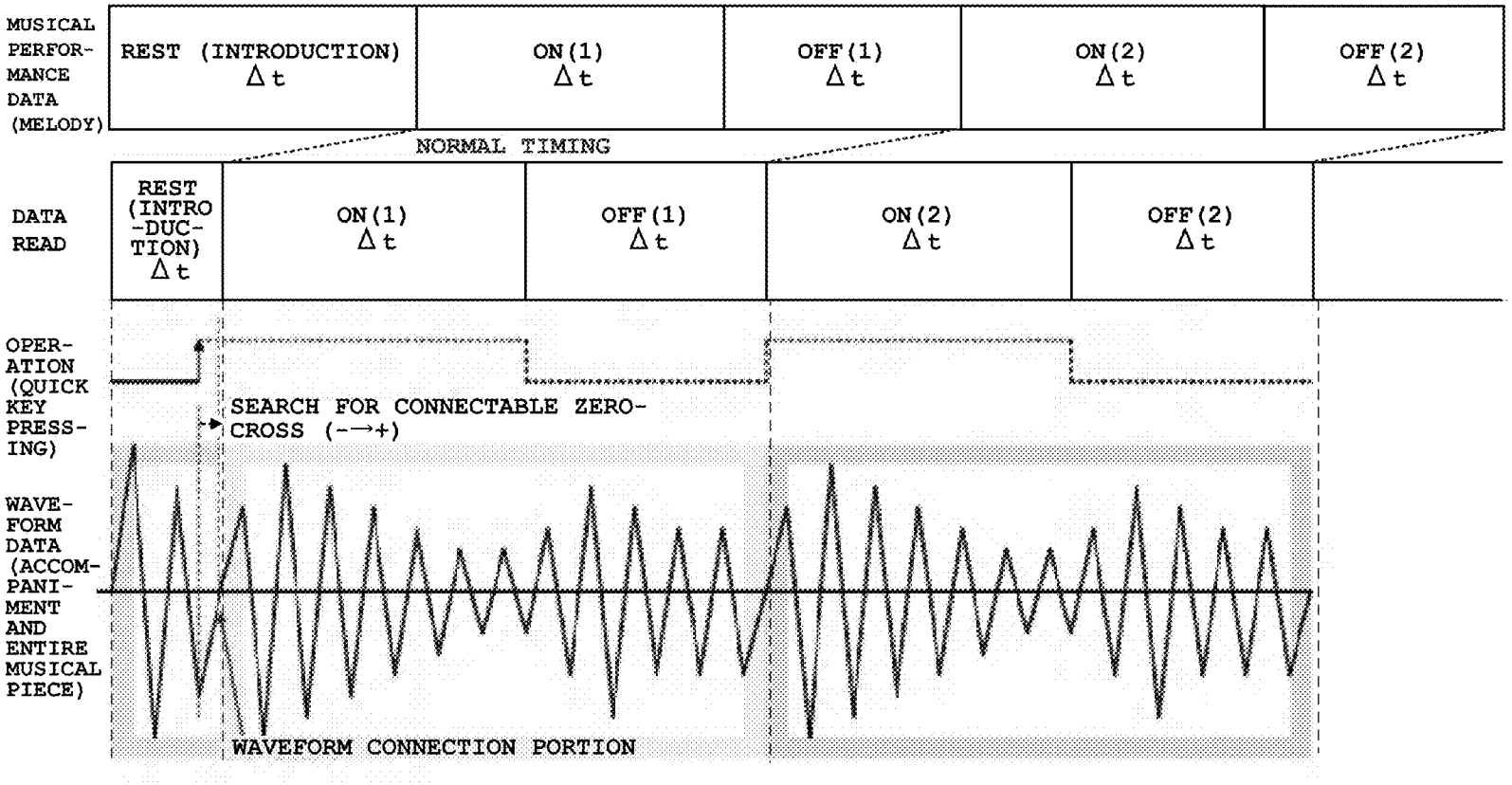
FIG. 9 is a diagram for describing the operation of keyboard processing at Step SC10 (waveform connection when key pressing is quick)

Conversely, when judged that the guided key of the next pitch NP has been pressed, since the judgment result at Step SF11 is "YES", the CPU 10 proceeds to Step SF12, and judges whether the time has reached the jump-origin time obtained at Step SC11 of the above-described keyboard processing (refer to FIG. 8). When judged that the time has not reached the jump-origin time, since the judgment result herein is "NO", the CPU 10 once ends the processing. When judged that the time has reached the jump-origin time, since the judgment result at Step SF12 is "YES", the CPU 10 proceeds to Step SF13.

Then, at Step SF13, the CPU 10 instructs the sound source 18 to cancel the audio loop replay. Then, the CPU 10 proceeds to Step SF7, and resets the correct key press flag SF to zero. Next, at Step SF8, the CPU 10 updates the song replay time SSJ to a jump-destination time (note-on event time of the next musical performance data). Next, at Step SF9, the CPU 10 updates and registers a note number during the note-on event of the next musical performance data read out from the memory card 17 as the next pitch NP in the work area WE of the RAM 12, and also updates and registers Δt of the note-on event in the work area WE of the RAM 12. Then, the CPU 10 proceeds to Step SF10, and instructs the sound source 18 to perform audio normal replay from the jump-destination time.

As such, when the guided key of the next pitch NP is pressed during the loop replay of the musical-piece waveform data, the CPU 10 instructs the sound source 18 to cancel the audio loop replay as soon as the jump-origin time is reached. In addition, the CPU 10 updates the song replay time SSJ to a jump-destination time (note-on event time of the next musical performance data), updates the next pitch NP and Δt based on the next musical performance data, and instructs the sound source 18 to perform audio normal replay from the jump-destination time.

b. In the Case where the Time has Reached the Next Event Timing

Figure 12:
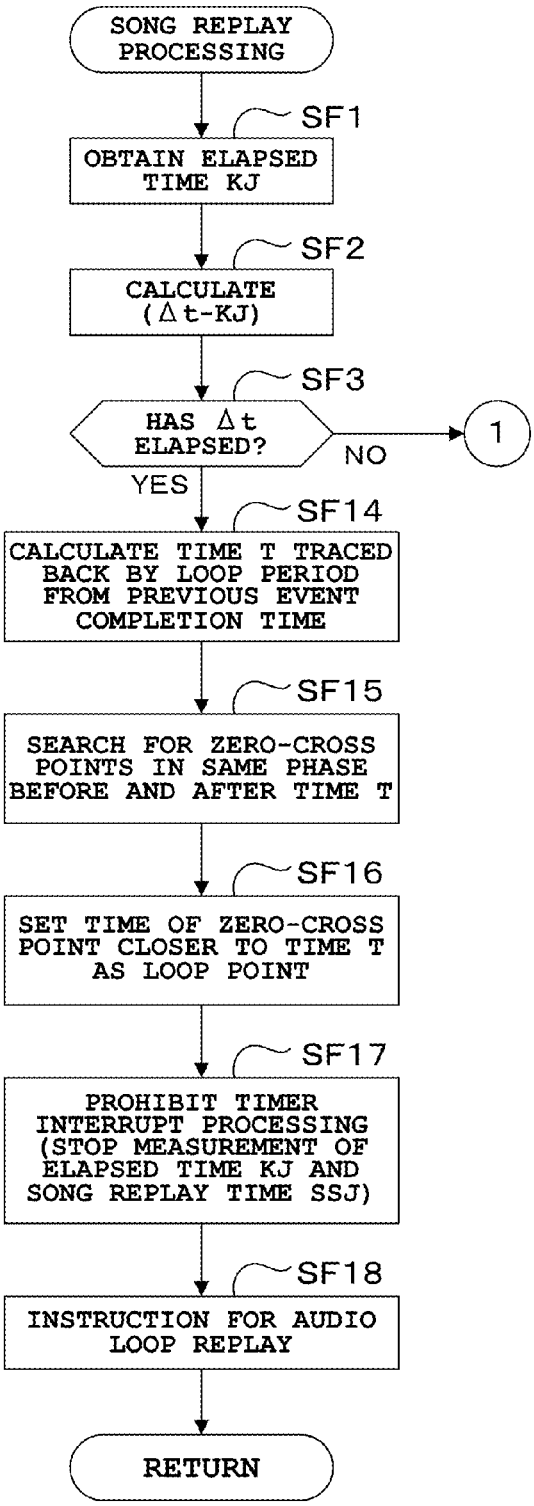
FIG. 12 is a flowchart of the operation of song replay processing.

When the time (Δt−KJ) is equal to or smaller than "0" and has reached the next event timing, since the judgment result at Step SF3 (refer to FIG. 12) is "YES", the CPU 10 proceeds to Step SF14 depicted in FIG. 12. At Steps SF14 to SF15, the CPU 10 performs loop start point search processing. Here, the operation of the loop start point search processing at Steps SF14 to SF15 is described with reference to FIG. 14.

Figure 14:
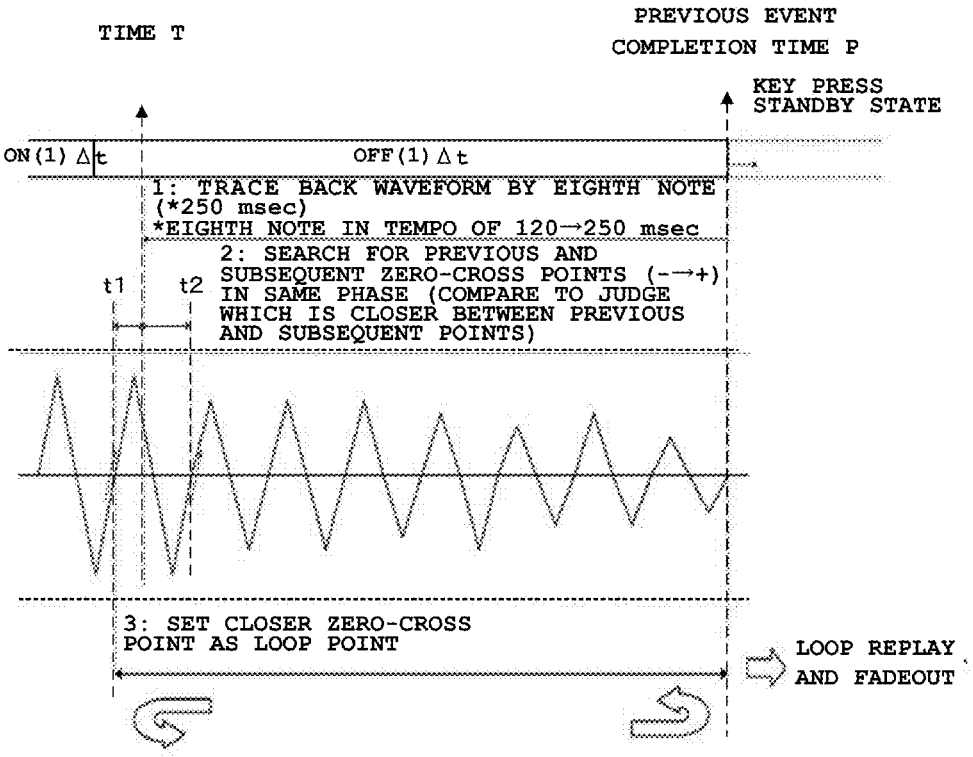
FIG. 14 is a diagram for describing the operation of the song replay processing.

First, at Step SF14, the CPU 10 calculates a time T traced back by the loop period LP from a previous event completion time P depicted in FIG. 14, that is, an end address of the musical-piece waveform data. The loop period LP is obtained at Step SE1 of the above-described song start processing (refer to FIG. 11). For example, when the beat information corresponding to the minimum note length of the musical piece for automatic accompaniment indicates eight beats (an eighth note) and the tempo information indicating the tempo of the musical piece is 120 bpm, the loop period LP corresponding to an eighth note length is 250 msec.

Subsequently, at Step SF15, a search is made for a waveform zero-cross point in a phase where a change is made from "−" to "+" before and after the time T depicted in FIG. 14. In an example depicted in FIG. 14, a search is made for a time t1 and a time t2 as waveform zero-cross points in the phase where a change is made from "−" to "+" before and after the time T. Then at Step SF16, the CPU 10 sets the time t1 of the waveform zero-cross point that is closer to the time T as a loop start point. As such, by a loop start point being set according to the loop period LP corresponding to the beat (a minimum note length) of the musical piece, the loop replay of accompaniment sound with a natural beat can be performed during standby until the guided key is pressed.

Then, the CPU 10 proceeds to Step SF17, and prohibits timer interrupt processing by an interrupt mask so as to stop the measurement of the elapsed time KJ and the song replay time SSJ. Subsequently, at Step SF18, the CPU 10 instructs the sound source 18 to perform the audio loop replay of the musical-piece waveform data from the set loop start point to the previous event completion time P, and ends the processing.

As such, when the next event timing is reached, and key pressing is not performed, a loop start point is set in accordance with the loop period LP corresponding to the beat (minimum note length) of the musical piece, and the audio loop replay of the musical-piece waveform data is performed from the set loop start point to the previous event completion point P (end address) Therefore, until the guided key is pressed, the loop replay of accompaniment sound with a natural beat can be performed during standby.

(7) Operation of Sound Source Sound-Emission Processing

Figure 15:
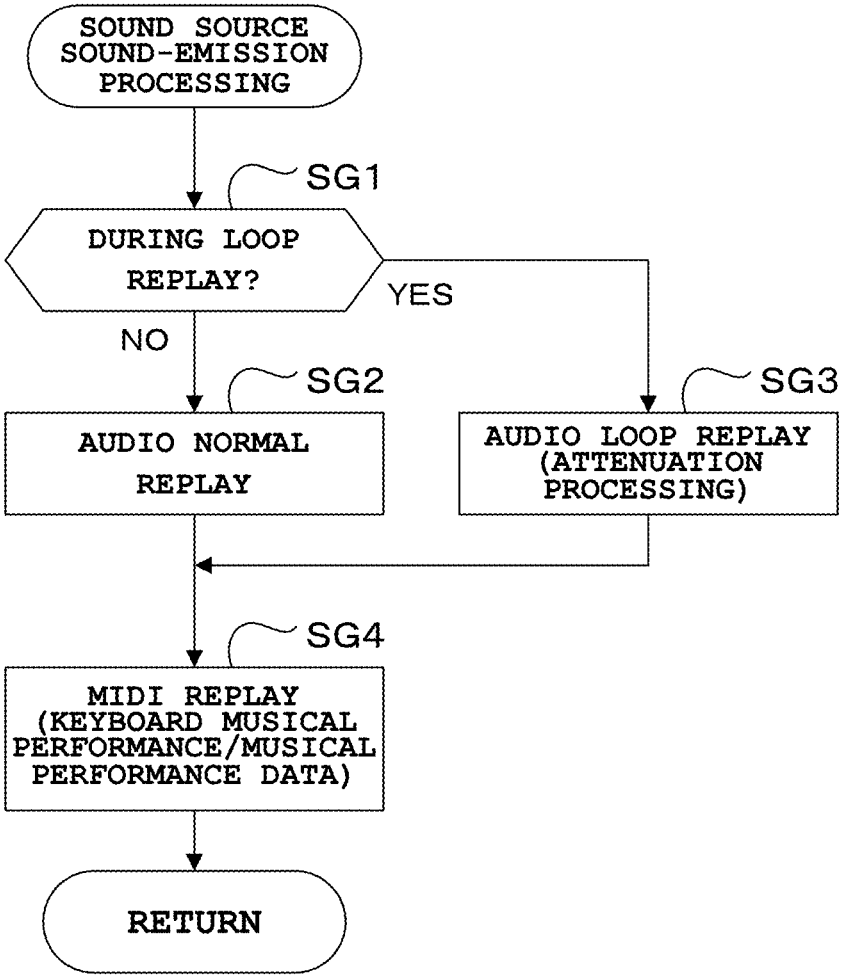
FIG. 15 is a flowchart of the operation of sound source sound-emission processing.

Next, the operation of the sound source sound-emission processing is described with reference to FIG. 15. When this processing is performed via Step SA5 (refer to FIG. 6) of the above-described main routine, the CPU 10 proceeds to Step SG1 depicted in FIG. 15, and judges whether loop replay is being performed. When judged that loop replay is not being performed, since the judgment result is "NO", the CPU 10 proceeds to Step SG2, performs the audio normal replay of the musical-piece waveform data according to the song replay time SSJ, and then proceeds to Step SG4.

When judged that loop replay is being performed, since the judgment result at Step SG1 is "YES", the CPU 10 proceeds to Step SG3, and performs the loop replay of the musical-piece waveform data with the song replay time SSJ being stopped. In this loop replay, it is preferable to perform fade-out processing for gradually attenuating the amplitude level of the replayed accompaniment sound. Then, the CPU 10 proceeds to Step SG4, generates musical sound by MIDI replay according to musical performance information generated by the key pressing/releasing operation of the keyboard 13, and ends the processing.

As described above, a musical performance device of the present embodiment uses a lesson function for guiding a user to a key to be played next based on musical performance data representing respective notes composing a musical piece and waiting until the guided key is pressed, and thereby performs the audio replay of musical-piece waveform data as accompaniment sound in synchronization with musical sound generated in response to the press of the key guided by the lesson function. In this musical performance device, a loop period LP corresponding to the beat (minimum note length) of the musical piece is previously obtained from the musical performance data. When key pressing is not performed even after the key-press timing of the guided key is reached, a loop start point in the musical-piece waveform data is set in accordance with the obtained loop period LP, and the audio loop replay of the musical-piece waveform data is performed from the set loop start point to an end address. Therefore, the audio replay of accompaniment sound with a natural beat can be performed during standby for key press.

In the present embodiment, the loop period LP is obtained in real time from beat information and tempo information included in the header information HD of musical performance data. However, the present invention is not limited thereto, and a configuration may be adopted in which the loop period LP is Provided as the header information HD of musical-performance data or the time and address of a loop start point are registered in advance.

While the present invention has been described with reference to the preferred embodiments, it is intended that the invention be not limited by any of the details of the description therein but includes all the embodiments which fall within the scope of the appended claims.

What is claimed is:

1. A musical performance device comprising:

a guide section which guides a user by indicating at least a timing of a musical performance operation to be performed next, based on musical performance data representing a musical piece, and waits until the musical performance operation is performed by the user in response to the guiding even after the timing of the musical performance operation is reached;

a normal replay section which performs normal audio replay of musical-piece waveform data prepared in advance as accompaniment sound in synchronization with musical sound generated in response to the musical performance operation guided by the guide section;

a loop period obtaining section which obtains a loop period corresponding to a beat of the musical piece from the musical performance data;

a loop point setting section which sets a loop start point and a loop end point in the musical-piece waveform data in accordance with the loop period obtained by the loop period obtaining section in a case in which the musical performance operation is not performed by the user in response to the guiding when the timing of the musical performance operation is reached;

a loop replay section which stops the normal audio replay of the musical-piece waveform data by the normal replay section, and which performs loop replay of the musical-piece waveform data from the loop start point to the loop end point of the musical-piece waveform data set by the loop point setting section; and a replay controlling section which (i) controls the loop replay section to stop the loop replay of the musical-piece waveform data, and (ii) controls the normal replay section to restart the normal audio replay of the musical-piece waveform data from a point at which the loop replay section stopped the normal audio replay of the musical-piece waveform data by the normal replay section, in a case in which, while performing the loop replay of the musical-piece waveform data, the musical performance operation is performed by the user in response to the guiding.

2. The musical performance device according to claim 1, wherein the loop period obtaining section includes a loop period calculating section which calculates the loop period corresponding to the beat of the musical piece according to beat information and tempo information included in the musical performance data.

3. The musical performance device according to claim 1, wherein the loop point setting section includes:

a waveform time calculating section which calculates a waveform time T traced back, by the loop period obtained by the loop period obtaining section, from the loop end point of the musical-piece waveform data at which the loop replay section stopped the normal audio replay of the musical-piece waveform data by the normal replay section;

a zero-cross time detecting section which detects times t1 and t2 of waveform zero-cross points in a phase where a change is made from "−" to "+" before and after the waveform time T in the musical-piece waveform data calculated by the waveform time calculating section; and a setting section which sets, as the loop start point, one of the times t1 and t2 of the waveform zero-cross points detected by the zero-cross time detecting section which is closer to the waveform time T in the musical-piece waveform data calculated by the waveform time calculating section.

4. A musical performance method for use in a musical performance device, the method comprising:

a step of guiding a user by indicating at least a timing of a musical performance operation to be performed next, based on musical performance data representing a musical piece, and waiting until the musical performance operation is performed by the user in response to the guiding even after the timing of the musical performance operation is reached;

a step of performing normal audio replay of musical-piece waveform data prepared in advance as accompaniment sound in synchronization with musical sound generated in response to the guided musical performance operation;

a step of obtaining a loop period corresponding to a beat of the musical piece from the musical performance data;

a step of setting a loop start point and a loop end point in the musical-piece waveform data in accordance with the obtained loop period in a case in which the musical performance operation is not performed by the user in response to the guiding when the timing of the guided musical performance operation is reached;

a step of stopping the normal audio replay of the musical-piece waveform data, and of performing loop replay of the musical-piece waveform data from the set loop start point to the set loop end point of the musical-piece waveform data; and a step of stopping the loop replay of the musical-piece waveform data, and restarting the normal audio replay of the musical-piece waveform data from a point at which the normal audio replay of the musical-piece waveform data was stopped, in a case in which, while performing the loop replay of the musical-piece waveform data, the guided musical performance operation is performed by the user in response to the guiding.

5. The musical performance method according to claim 4, wherein the step of obtaining the loop period includes a step of calculating the loop period corresponding to the beat of the musical piece according to beat information and tempo information included in the musical performance data.

6. The musical performance method according to claim 4, wherein the step of setting the loop start point includes:

a step of calculating a waveform time T traced back, by the obtained loop period, from the loop end point of the musical-piece waveform data at which the normal audio replay of the musical-piece waveform data was stopped;

a step of detecting times t1 and t2 of waveform zero-cross points in a phase where a change is made from "−" to "+" before and after the calculated waveform time T in the musical-piece waveform data; and a step of setting, as the loop start point, one of the detected times t1 and t2 of the waveform zero-cross points which is closer to the calculated waveform time T in the musical-piece waveform data.

7. A non-transitory computer-readable storage medium having stored thereon a program that is executable by a computer, the program being executable by the computer to perform functions comprising:

guide processing for guiding a user by indicating at least a timing of a musical performance operation to be performed next, based on musical performance data representing a musical piece, and waiting until the musical performance operation is performed by the user in response to the guide processing even after the timing of the musical performance operation is reached;

normal replay processing for performing normal audio replay of musical-piece waveform data prepared in advance as accompaniment sound in synchronization with musical sound generated in response to the musical performance operation guided by the guide processing;

loop period obtaining processing for obtaining a loop period corresponding to a beat of the musical piece from the musical performance data;

loop point setting processing for setting a loop start point and a loop end point in the musical-piece waveform data in accordance with the obtained loop period in a case in which the musical performance operation is not performed by the user in response to the guide processing when the timing of the musical performance operation is reached;

loop replay processing for stopping the normal audio replay of the musical-piece waveform data by the normal replay processing, and for performing loop replay of the musical-piece waveform data from the loop start point to the loop end point of the musical-piece waveform data set by the loop point setting processing; and replay controlling processing for (i) controlling the loop replay processing to stop the loop replay of the musical-piece waveform data, and (ii) controlling the normal replay processing to restart the normal audio replay of the musical-piece waveform data from a point at which the normal audio replay of the musical-piece waveform data was stopped, in a case in which, while performing the loop replay of the musical-piece waveform data, the musical performance operation is performed by the user in response to the guide processing.

8. The non-transitory computer-readable storage medium according to claim 7, wherein the loop period obtaining processing includes loop period calculation processing for calculating the loop period corresponding to the beat of the musical piece according to beat information and tempo information included in the musical performance data.

9. The non-transitory computer-readable storage medium according to claim 7, wherein the loop start point setting processing includes:

waveform time calculation processing for calculating a waveform time T traced back, by the loop period obtained by the loop period obtaining processing, from the loop end point of the musical-piece waveform data at which the normal audio replay of the musical-piece waveform data was stopped;

zero-cross time detection processing for detecting times t1 and t2 of waveform zero-cross points in a phase where a change is made from "−" to "+" before and after the waveform time T in the musical-piece waveform data calculated by the waveform time calculation processing; and setting processing for setting, as the loop start point, one of the times t1 and t2 of the waveform zero-cross points detected by the zero-cross time detection processing which is closer to the waveform time T in the musical-piece waveform data calculated by the waveform time calculation processing.

* * * * *